United States Patent [19]

Swift

[11] 4,441,233

[45] Apr. 10, 1984

[54] SECURITY SEAL WITH WEAKENED PORTION IN STUD

[75] Inventor: Allan W. Swift, Denville, N.J.

[73] Assignee: E. J. Brooks Company, Newark, N.J.

[21] Appl. No.: 461,731

[22] Filed: Jan. 31, 1983

[51] Int. Cl.[3] ..... B65D 63/10

[52] U.S. Cl. ..... 24/16 PB; 24/30.5 P

[58] Field of Search ..... 24/265 AL, 265 EC, 16 PB, 24/17 AP, 30.5 P; 411/2

[56] References Cited

U.S. PATENT DOCUMENTS

| | | | |
|---|---|---|---|
| 173,066 | 1/1876 | Salmon et al. | 24/265 AL |
| 2,916,790 | 12/1959 | Thiebault | 24/265 EC |
| 3,501,814 | 3/1970 | Anderson et al. | 24/16 PB |
| 3,796,125 | 3/1974 | Campbell et al. | 411/2 |
| 4,001,919 | 1/1977 | Moberg et al. | 24/16 PB |
| 4,059,300 | 11/1977 | Moberg et al. | 24/16 PB |

*Primary Examiner*—Robert P. Swiatek
*Assistant Examiner*—Robert A. Hafer
*Attorney, Agent, or Firm*—Robert E. Ross

[57] ABSTRACT

A security seal formed of a single piece of molded plastic and comprising an elongated strap having a socket at one end a stud at a medial portion, and a free end having an aperture to be received on the stud before the stud and socket are engaged. The seal configuration provides a secure non-removable assembly and allows assembly with closure members having an aperture too small to allow the stud or socket to pass therethrough. In one embodiment of the invention, the stud has a weakened portion at the base in a position such that if the weakened portion is cut or broken, it cannot be re-attached by fusing.

7 Claims, 8 Drawing Figures

SECURITY SEAL WITH WEAKENED PORTION IN STUD

BACKGROUND OF THE INVENTION

This invention relates to seals of the type used to seal hasps on enclosures such as vehicle doors, mail bags, and the like where the function of the seal is to detect pilferage.

Known seals of this type are often formed of a single piece of molded plastic, with a socket formed on one end of a strap and a shackle of small diameter extending from the other end of the strap, with said shackle being adapted for locking non-removable engagement when pulled through the socket. A seal of this type is disclosed and claimed in U.S. Pat. No. 4,001,919 issued Jan. 11, 1977. The seal of that patent has been found to be highly satisfactory in many applications, however the locking portions are difficult to mold accurately, and tolerance variations sometimes cause the seal to be less secure than desired. It would be desirable to have larger locking means, such as male and female snap fastener portions, however in many applications where such a seal is used, the aperture in the staple through which the seal is assembled is too small to allow a snap fastener portion to pass therethrough.

Such seals are usually provided with a weakened portion in the shackle, which is intended to break when attempts are made by an unauthorized person to open the seal. However it has been found that in some instances a seal which has been broken at the weakened portion can be re-assembled without leaving readily noticeable evidence of tampering by fusing the broken ends together by heating with a match, cigarette lighter or the like.

SUMMARY OF THE INVENTION

A security seal formed of molded plastic which is particularly adapted for use with articles having staple and hasp closures such as are used on mail bags.

The seal comprises an elongated flat strap having a first fastener portion at one end and a second fastener portion at a medial portion. The end of the strap opposite the end carrying the first fastener portion carrier no fastener portion, so that it can pass freely through a staple, but has an aperture for being received and retained between the assembled fastener portion.

In a preferred embodiment of the invention, the first fastener portion is a socket and the second fastener portion is a stud, said fastener portions being capable of locking into non-separable assembly.

The stud is provided with a weakened portion at the base. The weakened portion has an axial length and configuration such that if it is broken and then re-sealed, the length of the stud is shortened an amount such that the stud cannot be re-engaged with the socket fingers.

BRIEF DESCRIPTION OF THE FIGURES OF THE DRAWING

FIG. 3 is a prespective view of the seal applied to the staple of a mail bag or the like.

DESCRIPTION OF THE ILLUSTRATED EMBODIMENT

Figure 1:
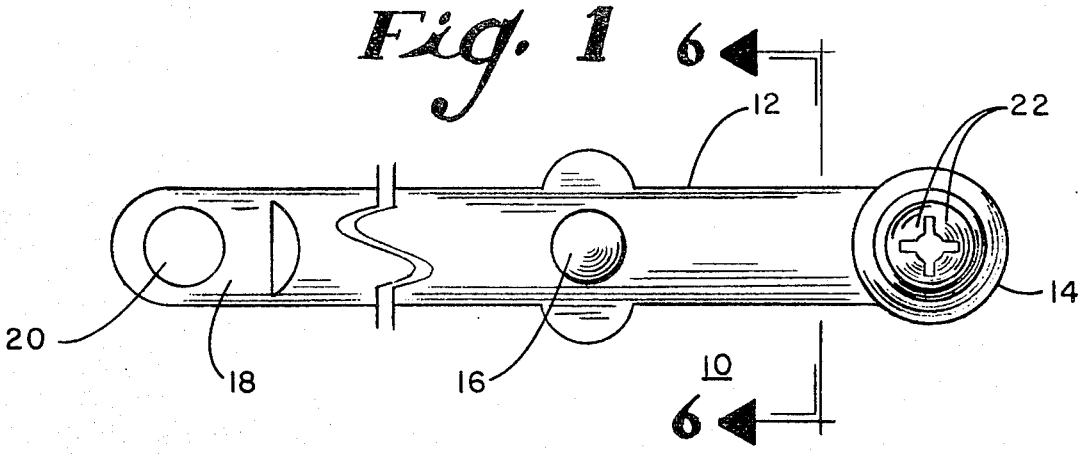
FIG. 1 is a top plan view of a seal embodying the features of the invention.
Figure 2:
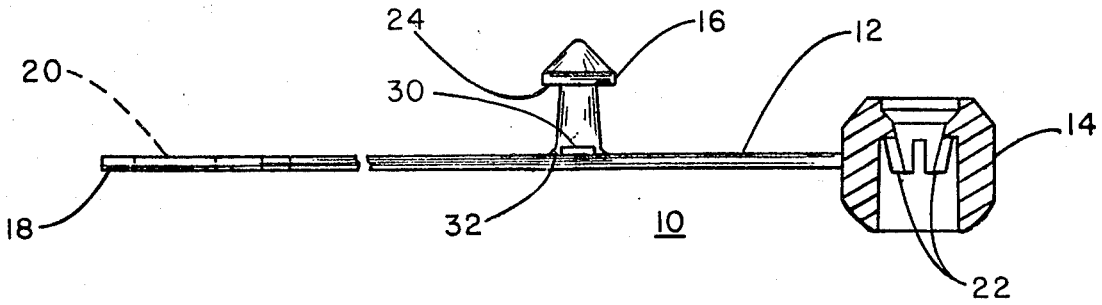
FIG. 2 is a view in side elevation partly in section of the seal of FIG. 1.

Referring to the drawing, there is illustrated a seal 10 which comprises an elongated flat strap 12 having a snap fastener socket 14 at one end, a stud 16 projecting from a medial portion of the strap and a strap free end 18 having an aperture 20.

In a preferred embodiment of the invention the socket has internal resilient fingers 22 and the stud has an abrupt shoulder 24 so dimensioned that the stud can snap into the socket with the fingers 22 seating behind the stud shoulder 24 to prevent removal of the stud without destroying the fastener.

Figure 3:
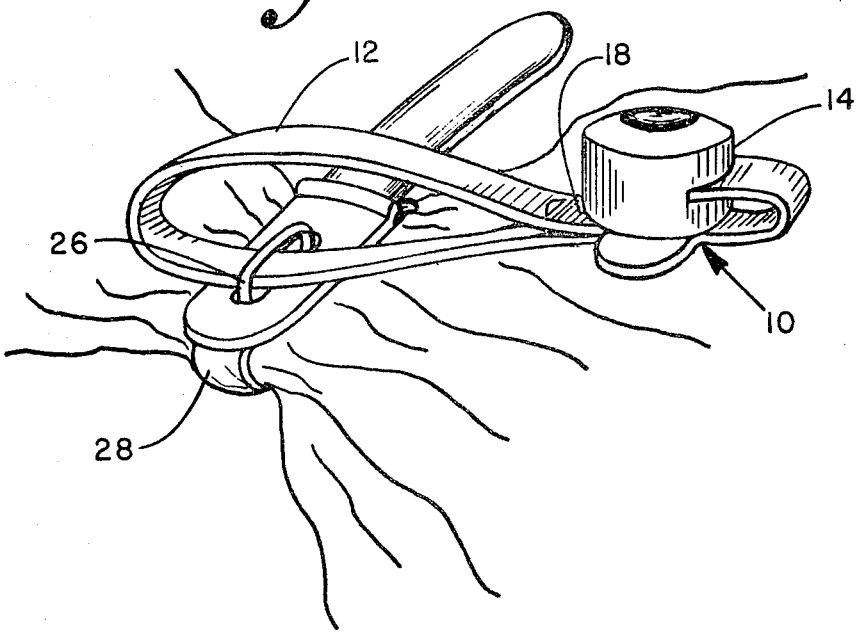

The seal 10 is intended for assembly through a staple 26 of a mailbag strap 28, with the free end portion 18 then being bent back on itself so that the aperture 20 may be placed over the stud 16. The portion of strap between the socket and stud may then be bent to allow the socket to snap over the stud as seen in FIG. 3.

The socket and stud, because of their size, allow a more secure locking engagement than seals previously used for this purpose, yet the free end 18, since it does not carry a fastener portion, is capable of being inserted through a staple in a staple and hasp assembly too small to allow a fastener portion to pass through.

To increase the security of the seal by allowing tampering to be detected, the stud 16 is provided with a weakened portion with a configuration that can resist the compressive forces applied to the stud during assembly yet will rupture when tensile forces are applied thereto, such as result on attempts to pry the stud out of the socket.

In the illustrated embodiment the weakened portion is provided by a pair of slots 30 formed in opposite sides of the shank of the stud at the junction with the strap, forming a connecting web portion 32 which is appreciably smaller in cross-sectional area than the remainder of the shank.

When the socket is snapped onto the stud, the resulting compressive forces may tend to cause the narrow shank portion to collapse, however due to the fact that the slots 30 are not wide in an axial direction and are at the bottom of the stud shank, the distance that the stud can move downwardly is limited, which tends to prevent sideways collapsing of the shank.

However, when a tensile force is applied to the shank, as when an unauthorized person is attempting to open the seal, the narrow shank portion readily ruptures. If desired the slots 30 may be formed as a single cavity extending entirely around the periphery of the base of the shank.

As mentioned above, one method of attempting to defeat seals of this type is to fuse the broken ends together by the use of heat. In the case of seals in which the weakened portion is in the shackle, the ends of a shackle broken at the weakend portion can be heated simultaneously and forced together. The fact that a small length of shackle is lost in this process usually is of no consequence.

In the present case, after the stud has broken from the strap at the weakened portion at the base, the stud may be pushed out of the socket and re-attached to the shackle by fusion. Although this attachment is more difficult than attaching broken shackle ends by fusing, it can be done with sufficient time by a person experienced in such matters.

However, the act of fusing necessarily shortens the overall length of the stud by a small amount, which amount is at least equal to the thickness of the slots 30, since the connecting web 32 will be destroyed in the fusing process.

In the manufacture of the seal, there must be a manufacturing tolerance in the dimensions of the stud 16 and the fingers 22 to insure that the fingers will snap behind the shoulder 24 when the stud is fully inserted into the socket.

Figure 4:
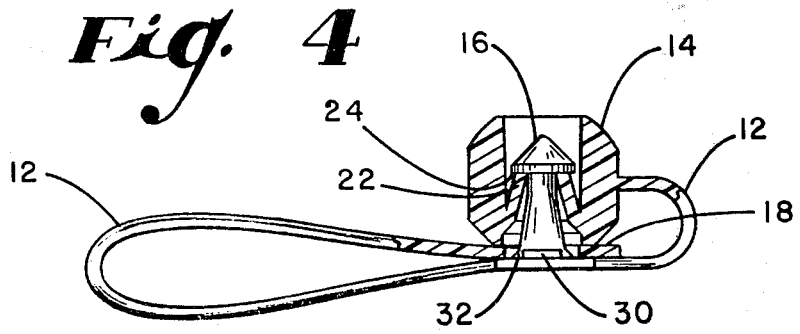
FIG. 4 is a view in side elevation, partly in section of the seal in which the components have been assembled with each other in the intended manner.
Figure 5:
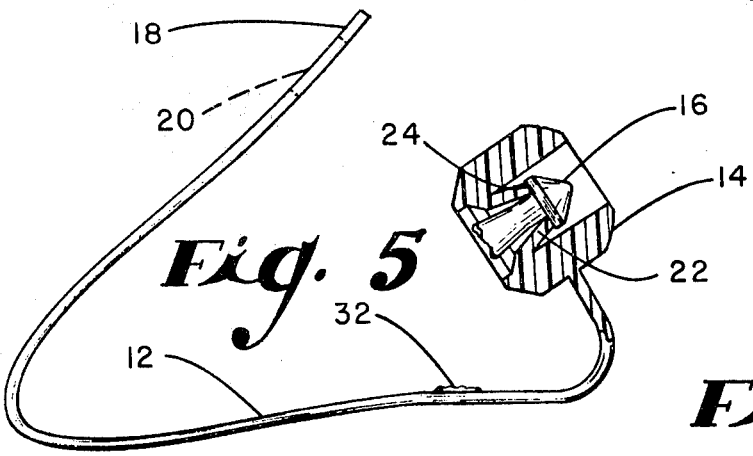
FIG. 5 is a view of the seal of FIG. 4 in which the stud has been ruptured and the seal opened.
Figure 6:
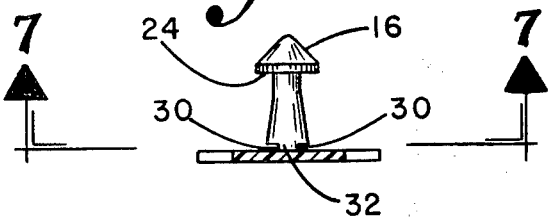
FIG. 6 is a view taken on line 6—6 of FIG. 1.
Figure 7:
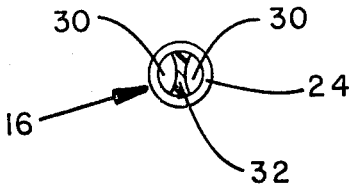
FIG. 7 is a view taken on line 7—7 of FIG. 6.
Figure 8:
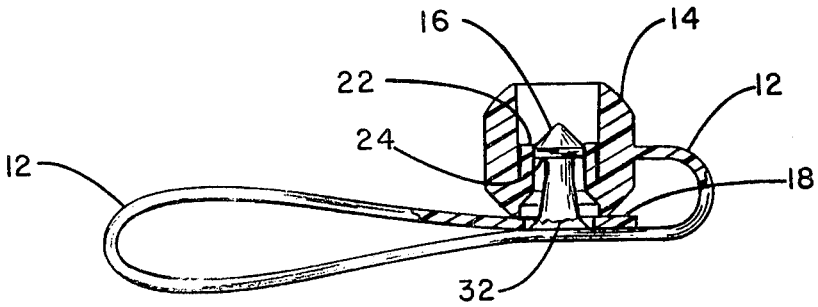
FIG. 8 is a view of the seal of FIG. 5 after the stud has been re-fused onto the strap, illustrating an attempt to re-attach the stud into the socket.

In a typical seal of the type described herein, the length of the stud is such that the distance from the outer face of the strap 18 to the under side of the stud shoulder 24 (when the stud is assembled as shown in FIG. 4) is about 0.010 inches greater than the distance from the face of the socket on the stud entering side to the ends of the fingers. The axial length of the slots is about 0.030 inches. Therefore when the stud is broken at the weakened portion and re-sealed onto the strap, the stud length is decreased by about 0.030 inches. When the socket is thereafter placed over the stud to re-assemble the seal, (see FIG. 8) the stud is now too short to allow the shoulder 24 to pass beyond the ends of the fingers 22, and the stud cannot be locked into the socket.

Although the friction of the fingers on the head of the stud may tend to temporarily hold the stud and socket together, the spring action of the bent shackle portion between the stud and socket will force the socket off of the stud.

Although in the illustrated embodiment of the invention the socket 14 is open at the end opposite to that at which the stud enters, if desired this end may be closed in any convenient manner, such as by heat sealing a plug into the opening, to provide a more secure seal.

Since certain other changes apparent to one skilled in the art may be made in the herein described embodiments of the invention without departing from the scope thereof, it is intended that all matter contained herein be interpreted in an illustrative and not a limiting sense.

I claim:

1. A security seal formed of a single piece of molded plastic, comprising an elongated flat strap, an integral snap fastener socket formed at one end of the strap, said socket having a central aperture with internal resilient fingers, an integral stud extending upwardly from a medial portion of the strap spaced from both ends thereof, said stud having a shank and an enlarged head with an abrupt shoulder between the head and the shank, said stud and socket being dimensioned to allow the stud to be assembled into the socket in locking non-removable engagement with the fingers seating behind the stud shoulder, said stud being spaced from the socket on the strap far enough to allow the strap to be bent back on itself to allow the stud and socket to become engaged, and an aperture in the other end of the strap, the strap length between the stud and the aperture being sufficient to allow said other end of the strap to be passed through an aperture of a closure member to be sealed and then folded back on itself with the stud being received in the aperture in said other end, said other end being retained in assembly on the stud by the assembled socket.

2. A seal as set out in claim 1 in which the shank of the stud has a weakened portion formed therein which has a cross-sectional area substantially less than that of the remainder of the shank, said weakened portion having an axial length greater than the space between the ends of the fingers of the socket and the abrupt shoulder on the stud when the stud is fully inserted into the socket.

3. A seal as set out in claim 2 in which the weakened portion is disposed in the shackle at the junction thereof with the strap.

4. A seal as set out in claim 2 in which the weakened portion has an axial length greater than the space between the ends of the fingers and the abrupt shoulder when the stud is fully assembled into the socket.

5. A security seal, comprising a shackle, a stud and socket disposed on the shackle in spaced relation, and being shaped and dimensioned for locking engagement, said stud comprising a shank extending from the shackle and an enlarged head forming a locking shoulder, said socket comprising a stud-receiving aperture opening to a face thereof, and resilient fingers in said aperture inclined inwardly and away from said face and having ends positioned for snapping into locking engagement behind the locking shoulder of the assembled stud, said stud having a weakened portion in the shank which comprises a web having a cross-sectional area substantially less than that of the remainder of the shank, said weakened portion extending axially a distance such that if the stud is broken at the weakened portion and the broken ends fused together so that the web is destroyed, the length of the stud is so reduced that on insertion of the stud into the socket in the manner intended the locking shoulder cannot reach the ends of the fingers, whereby locking of the stud in the socket is prevented.

6. A seal as set out in claim 5 in which the dimensions of the stud and socket are such that when the stud is fully inserted into the socket, the locking shoulder extends beyond the ends of the fingers a predetermined distance and the axial length of the weakened portion in substantially greater than said distance.

7. A security seal formed of a single piece of molded plastic, comprising an elongated shackle, a first integral snap fastener portion formed at one end of the shackle, and a second integral snap fastener portion formed at a radial portion of the shackle spaced from both ends thereof, said snap fastener portion being shaped and dimensioned for locking non-removable engagement, the second snap fastener portion being spaced from the first snap fastener portion far enough to allow the portion of the shackle therebetween to be bent back on itself to enable the snap fastener portions to become engaged, the portion of the shackle extending from the second snap fastener portion away from the first snap fastener portion having an aperture at a distance from the second snap fastener portion such that said portion of the shackle may be passed through an aperture of a closure member to be sealed and then folded back on itself with one of said snap fastener portions being received in the aperture, said portion having the aperture being retained in assembly on said snap fastener portion by the assembled other snap fastener portion.

* * * * *